United States Patent [19]

Farrington et al.

[11] 3,930,299

[45] Jan. 6, 1976

[54] METHODS OF AND/OR APPARATUS FOR JOINING TIMBER MEMBERS

[75] Inventors: Lee Charles Farrington; Edgar Edward Dagley, both of Auckland, New Zealand

[73] Assignee: Automated Building Components, Inc., Auckland, New Zealand

[22] Filed: Nov. 16, 1973

[21] Appl. No.: 416,675

[30] Foreign Application Priority Data

Nov. 16, 1972 New Zealand ..... 169020

[52] U.S. Cl. ..... 29/526; 29/429; 227/113; 227/152

[51] Int. Cl.[2] ..... B25C 7/00

[58] Field of Search ..... 29/429, 200 P, 526; 227/152, 44, 45, 48, 50, 99, 101, 118, 110, 113, 117; 100/DIG. 13; 269/321 F; 144/288 C

[56] References Cited

UNITED STATES PATENTS

| | | | |
|---|---|---|---|
| 3,207,406 | 9/1965 | Bowman | 227/152 |
| 3,716,179 | 2/1973 | Frydenberg | 227/152 |

*Primary Examiner*—C. W. Lanham
*Assistant Examiner*—Joseph A. Walkowski
*Attorney, Agent, or Firm*—Holman & Stern

[57] ABSTRACT

A method and apparatus for end jointing timber members such as floor or ceiling joists by means of spiked timber connector plates, using apparatus incorporating equipment to position and hold the timber and automatically feed connector plates from cassettes or magazines holding a supply of connector plates onto magnetized pressing platens which then rotate to position the connector plates to span the joint to be made before passing the spikes into the relevant timber members.

5 Claims, 6 Drawing Figures

METHODS OF AND/OR APPARATUS FOR JOINING TIMBER MEMBERS

This invention relates to methods of and/or apparatus for joining timber members and has been designed particularly though not solely for use in joining floor joists.

At present joints for floor joists have, for strength requirements, been positioned over plates or runners supported by ribs. This necessitates sorting out timber to the required length and in some cases results in waste when excess lengths of wood are cut off so that the joints will be correctly positioned. Also the procedure is time consuming since the cutting is usually effected on the job, necessitating extra carrying to and from a cutting machine such as a draw saw or cutting by handsaw which is slow or hand held circular saw which has potential danger.

SUMMARY OF THE INVENTION

It is therefore an object of the present invention to provide a method of and/or apparatus for joining timber members which will obviate or minimise the foregoing disadvantages or which will at least provide the public with a useful choice.

Accordingly in one aspect the invention consists in a method of joining timber members comprising the steps of temporarily placing at least one spiked timber connector plate so that said connector plate is held on at least one of a pair of pressing platens, moving a plurality of timber member to desired positions for joining, moving the held connector plate or plates to a position to span the required joint between the timber members either before or after moving said timber members, pressing said platens towards each other so that the spikes of said connector plate or plates are embedded in said timber members to join them together, and retracting at least one of said platens leaving said connector plate or plates embedded in said timber members.

In a further aspect the invention consists in apparatus for use in joining timber members using spiked timber connector plates, said apparatus comprising a frame, a pair of platens in said frame adapted to be moved towards each other with appropriate force, connector plate supply means adapted to supply one or a set of connector plates onto an appropriate surface of one or each platen, and moving and positioning means adapted to move and position said connector plates or set of connector plates in a position where said connector plate or plates spans the joint between the timber members to be connected, the construction and arrangement being such that in use one or a set of connector plates delivered to one or each of said platens are moved and positioned so that the connector plate or plates span the joint to be made and the platens are then moved to press the spike of each connector plate into the timber so as to make a joint between two or more timber members appropriately positioned in the apparatus.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF THE DRAWINGS

One preferred form of the invention will now be described with reference to the accompanying drawings in which.

DESCRIPTION OF THE PREFERRED EMBODIMENTS

Figure 1:
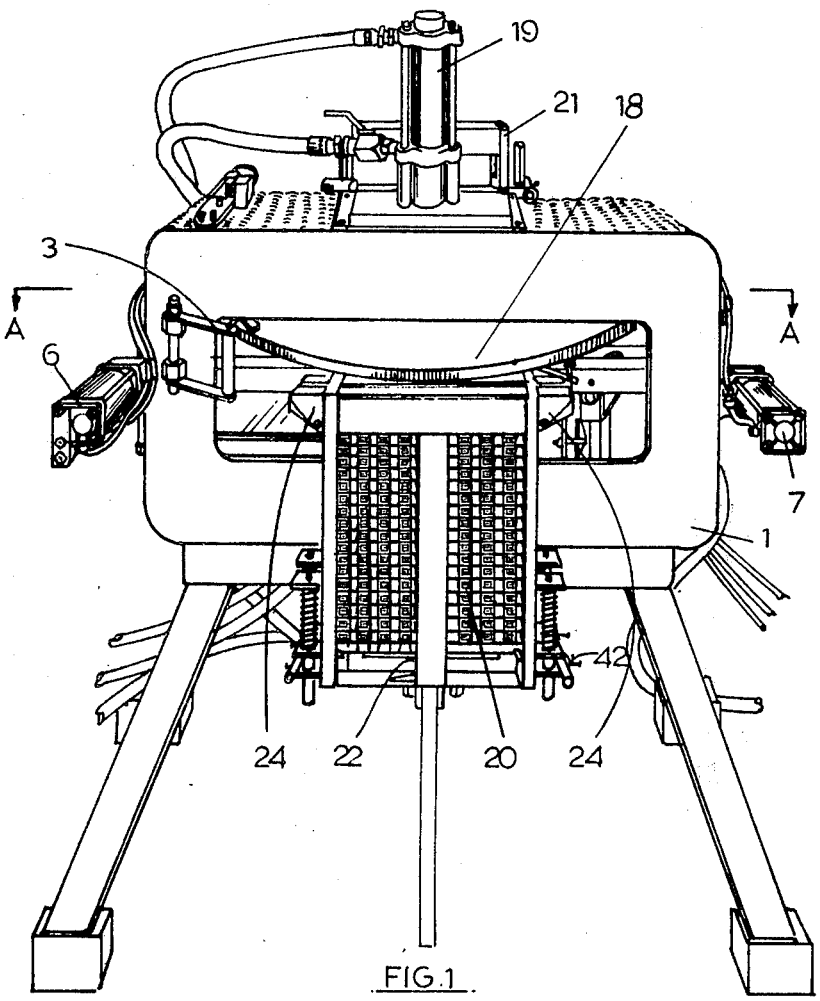
FIG. 1 is a front elevational of apparatus for end joining timber members according to the invention.
Figure 2:
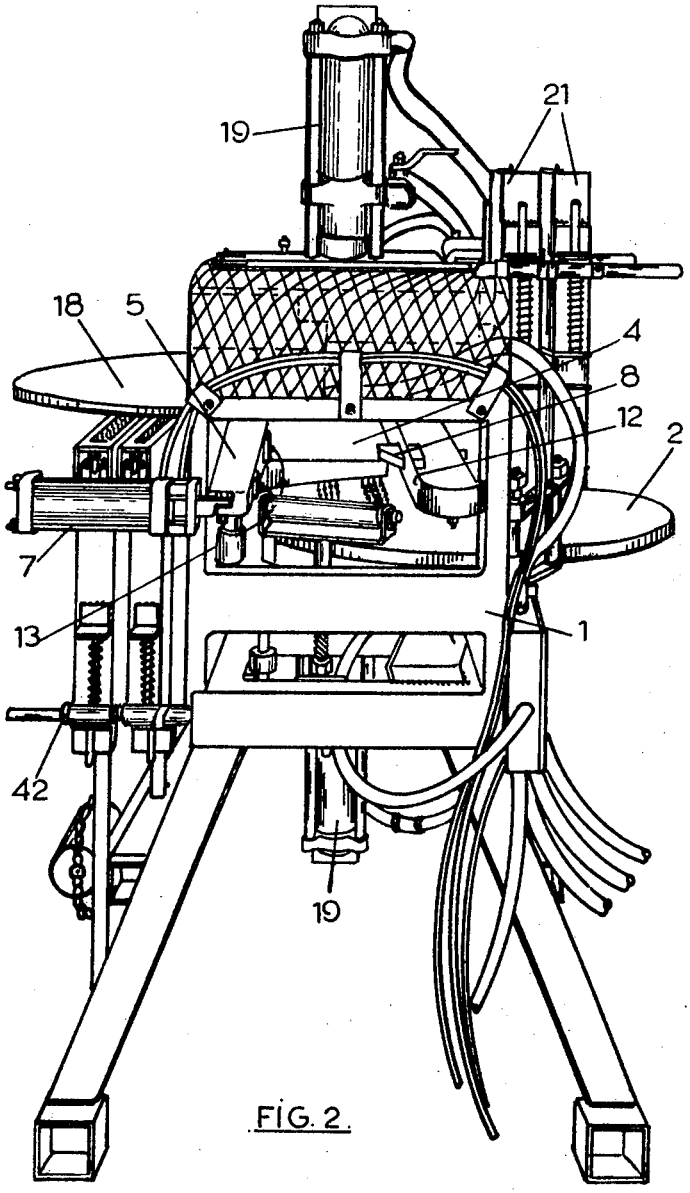
FIG. 2 is a side view of the apparatus shown in FIG. 1.
Figure 3:
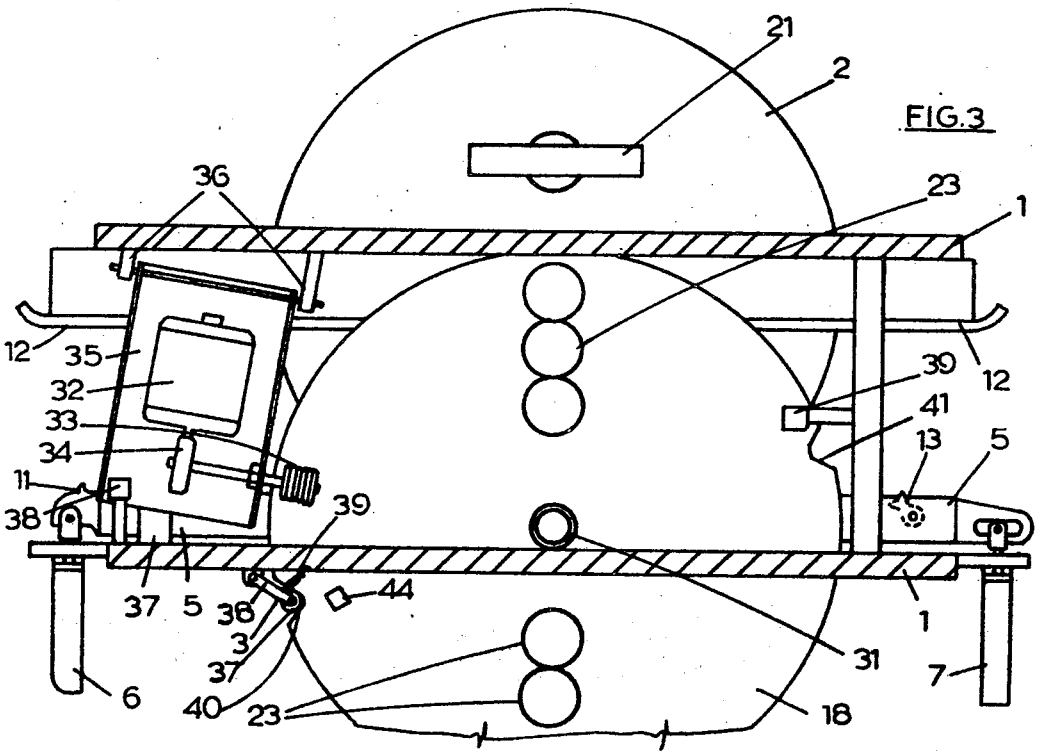
FIG. 3 is a cross sectional plan view along the line A—A of FIG. 1.
Figure 4:
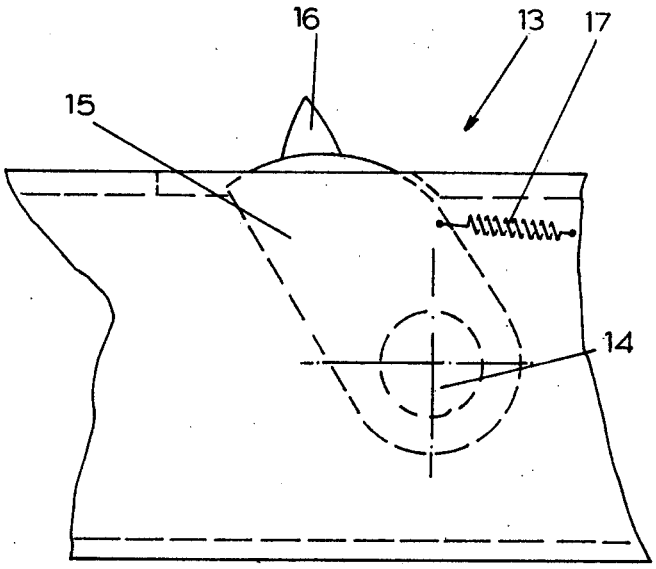
FIG. 4 is an enlarged fragmentary view of the eccentric knobs shown in FIG. 2.
Figure 6:
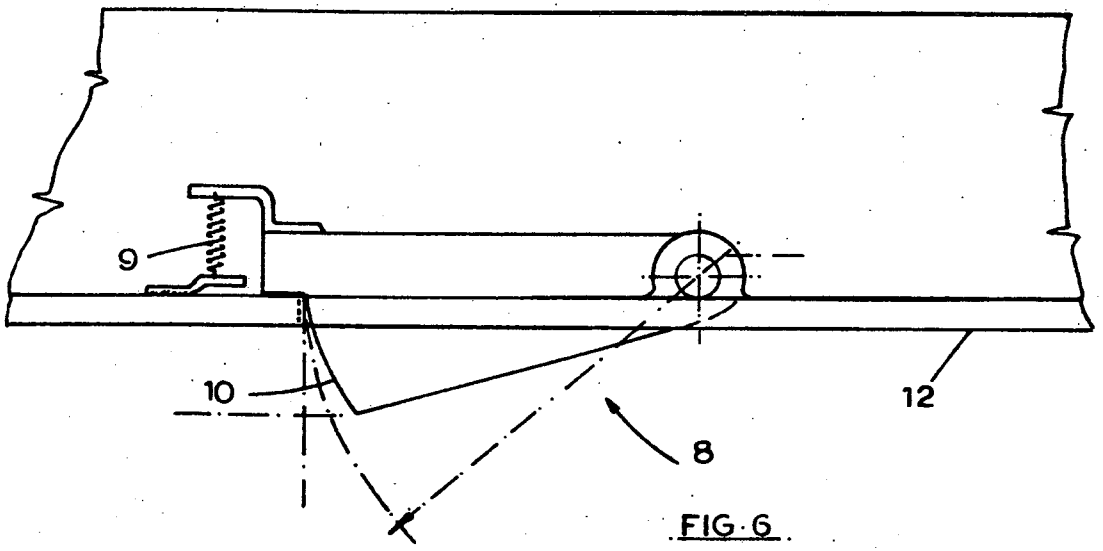
FIG. 6 is an enlarged fragmentary view of a spring loaded longitudinal stop means.

In the preferred form of the invention a method of and/or apparatus for end joining timber members using spiked timber connector plates is constructed as follows:

The preferred form of the apparatus will be described in relation to a machine for end joining floor or ceiling joists so as to form a continuous length of timber. A frame 1 is provided, and preferably the frame has positioned close to it a saw arranged so that the ends of the timber members may be cut off at an appropriate angle preferably square to the length of the timber. In frame 1 there is a lower pressing platen in the form of disc 2 adapted to rotate about a vertical axis. This platen is freely rotatable but positioning means are provided, for example, electromagnetically, pneumatically or hydraulically-operated stop means but preferably mechanical stop means 3 (FIG. 3) are operable so that the plate may be stopped in desired positions and these positions are such that the platen will rotate through 180° between stops. This platen is of course of suitably strong material and is suitably supported to resist the force which is to be applied to it. Above this platen there is a tunnel 4 through which the timber members to be joined will be moved. Movement of timber is generally in one direction through the machine so that pieces of timber will be drawn from a supply, fed into the machine, joined and then delivered to a required delivery station. To fix the timber in position and locate the ends to be joined, timber fixing means are provided comprising a longitudinal bar 5 arranged lengthwise of the timber and having two operating members e.g. hydraulic or preferably pneumatic piston and cylinder assemblies 6 and 7 one towards each end of the longitudinal bar. In addition, locating means in the form of a spring loaded detent 8 is provided so that a first timber member may be moved forwardly alongside support member 12 pressing detent 8 to one side against the action of spring 9 (FIG. 6) until the spring loaded detent is cleared by the trailing end of the timber member whereupon the detent will move into the tunnel under the influence of its spring and the first timber member may then be backed against an appropriate surface 10 of this detent to longitudinally fix the position of the squared end of the timber. First timber fixing means is then actuated i.e. bar 5 is operated by pneumatic piston and cylinder assembly 6 to lock the first timber member into position by way of engagement of holding member knob 11, with one side of the timber member forcing the timber member into position against support member 12. A second timber member is then simply entered into tunnel 4 until it presses against the squared end of the first timber member and the second timber fixing means i.e. pneumatic piston and cylinder assembly 7 is operated to force this second timber member into position against support member 12. The second timber member is further located against support member 12 and the end of the first timber member by way of a securing member in the form of eccentric knob 13 located on longitudinal bar 5 as shown in FIG. 4. Preferably two such eccentric knobs are provided each consisting of a pivot 14, an arm 15, a projecting knob 16 and a spring 17. The arrangement of the eccentric knobs is such that as long as longitudinal bar 5 acts to force a timber member against support 12 projecting knobs 16 will engage with one side of the timber member so tending to rotate arm 15 in an anti clockwise direction about pivot 14 as shown in FIG. 4. This rotational movement will then tend to move the second timber member longitudinally towards the first timber member so ensuring contact between the ends of the first and second timber members. Upon the withdrawal of bar 5 to release the timber the eccentric knob is returned to its previous position by the action of spring 17.

A top pressing platen is provided in the form of disc 18 both platens being adapted to be movable towards each other and to this end a short stroke hydraulic piston and cylinder 19 is provided for each platen together with an anvil (not shown) against the outer surface of the platen to move the platen under hydraulic pressure against the top and bottom surfaces of the timber members. The top platen is also arranged to be moved and positioned so that in successive positions appropriate parts of the platen are rotated through 180°.

Associated with each platen is a supply of spiked timber connector plates and each supply preferably supplies two connector plates for each of the two opposite sides of the timber members which are pressed upon the platen. To this end cassettes or magazines 20 and 21 are provided, cassettes 20 supplying connector plates to the upper platen and cassettes 21 supplying connector plates to the lower platen. Cassettes 20 are provided with spring loaded members 22 such that a spring (not shown) is pressed when connector plates are inserted in cassettes 20 the action of the spring then serving to position the upper connector plate in each cassette at substantially the same level regardless of the quantity of connector plates remaining in the cassette. This action could also of course be provided by other means such as counterbalance weights. The upper platen and preferably also the lower platen is provided with magnetic means in the form of a series of permanent magnets 23 which are appropriately positioned so that connector plates emerging from the cassettes are picked up by the platen and will adhere thereto.

Figure 5:
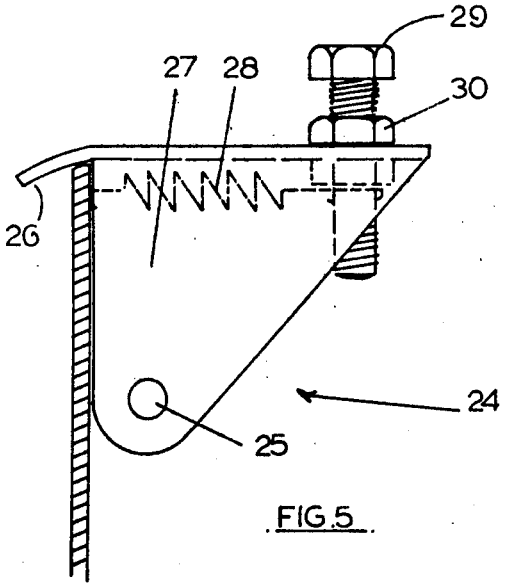
FIG. 5 is an enlarged fragmentary view of a connector plate retainer.

At the mouth of each cassette are provided two connector plate release means comprising retainers 24 pivoted to the outer sides of the cassette by way of pivots 25 (FIG. 5). Each retainer comprises a tongue 26 projecting into the mouth of the cassette so as to retain the connector plate adjacent to the mouth, a body 27, a return spring 28 and an adjustable actuating member 29 in the form of a bolt fastened to body 27 by means of lock nuts 30.

Platens 2 and 18 are adapted to be rotated about a vertical axis by moving means comprising rotation means in the form of an electric motor drive. For example, platen 18 is rotated about axis 31 by means of electric motor 32 driving friction drive wheel 33 by way of gear box 34. The motor, drive wheel and gear box are mounted on hinged mounting plate 35, hinged or pivoted to frame 1 by means of pivots 36. The movement of hinged plate 35 is limited by limit stop 37. The motor is controlled by switches 38 and 39 which are actuated by the vertical movement of hinged support plate 35, and a projection in the form of a raised block or ramp 44 located on the upper surface of platen 18 respectively. Platen 18 is rotationally located by stop means 3 comprising roller 37 pivotally attached to frame 1 by means of arm 38. Roller 37 is held in contact with the edge of disc 18 by means of spring 39. Notches 40 and 41 are provided in a periphery of disc 18 to engage with roller 37, notch 41 being displaced from notch 40 through an angle of 180° about axis 31.

Use of the apparatus is as follows:

A space into which the timber members may be inserted is adjustable, for example, to accommodate beams from 10″ × 4″ down to 4″ × 2″. The machine is set to receive, for example, the standard 5″ × 2″ joists. A first timber member has one end thereof squared and the timber is fed through the tunnel so that the squared end passes detent 8. The timber is then pulled back so that the squared end comes against surface 10 of detent 8 and the timber member is locked in position by the actuation of pneumatic piston and cylinder 6 to clamp the timber member between support 12 and knob 11. The second timber member then has one end squared and it also is passed into the machine so that the squared end butts against the squared end of the first timber member. Pneumatic piston and cylinder assembly 7 is then actuated to clamp the second piece of timber between longitudinal bar 5 and support 12, the action of eccentric knobs 13 further forcing the squared end of the second timber member against the squared end of the first timber member.

It will be assumed that a spiked timber connector plate or a set of connector plates is already in position on each platen so as to span the squared ends of the two timber members to be joined. Hydraulic piston-and-cylinder assemblies 19 are then actuated so that the spikes of the connector plates will be inserted into the timber of the members to be joined by the pressing action of the upper and lower platens on the top and bottom surfaces of the timber members.

Simultaneously, the upper platen will also approach the mouths of lower cassettes 20 and the lower platen will approach the mouths of upper cassettes 21, the surface of the platen bearing against the head of each bolt 29 and so pivoting bodies 27 about pivots 25 so as to withdraw tongues 26 from the mouth of the cassettes. This action then allows a connector plate in each cassette adjacent to the mouth to come into contact with the surface of the platen where it is held by the action of the magnets in the platen. Simultaneously hinged plate 35 has been allowed to rotate about pivots 36 until it comes into contact with limit stop 37, this action tiggering switch 38 to start motor 32. Friction drive wheel 33 is therefore rotating as the connector plates are pressed into the timber members.

Upon the reversal of pressure to hydraulic piston-and-cylinder-assemblies 19, platens 2 and 18 separate and return to their previous positions. As this happens springs 28 rotate each body 27 about pivot 25 so that tongues 26 will once more project into the mouth of the cassettes and retain the connector plates therein. As the platen 2 comes into contact with rotating friction drive wheel 33, the platen is rotated about axis 31 until a raised block or ramp 44 triggers switch 39 to stop the motor 32. At this point notch 41 is approximately aligned with stop means 3 so that roller 37 is pulled into notch 41 by the action of spring 39 to provide a positive location for platen 18.

It will of course be apparent that although the sequence of operations has been described for the rotation of upper platen 18, a similar set of apparatus is provided to rotate lower platen 2, the rotational operations taking place simultaneously.

It will be apparent that the connector plates previously positioned on the surface of the platen by the cassette will now be in a position to span the joint between a further two timber members.

Pneumatic piston-and-cylinder assemblies 6 and 7 are then released to withdraw longitudinal bar 5 and so release the timber members which are now connected to each other by connector plates in their upper and lower surfaces. The sequence may then be repeated as above.

Lower cassettes 20 may be replenished by sliding the cassette outwards on telescopic mounts 42 until the mouth of the cassette is visible from above beyond the edge of disc 18. Retaining tongues 26 are then withdrawn from the mouth of the cassette so that further connector plates may be inserted into the mouth of the cassette against the action of spring 22. Upper cassettes 21 of course do not have a spring loaded member as the connector plates contained therein are fed to the surface of platen 2 by the action of gravity. The upper cassettes may therefore be replenished by inserting new connector plates through the upper end of the cassettes.

It will be seen that by this machine a very quick operating timber jointing method is provided in which particular timber members may be joined end-to-end in a very speedy manner giving adequate strength to the timber member so formed. If desired other timber members may also be joined, for example, three members could be joined together in a T formation in which event the arc of movement of platens 2 and 18 may be different from the 180° movement mentioned above so that the cassettes will clear the extra members provided. However the machine has been designed specifically though not solely for use in joining floor or ceiling joists end to end as above described.

We claim:

1. A method of joining timber members comprising the steps of temporarily placing a pair of spiked timber connector plates and holding the connector plates on a pair of spaced, substantially parallel platens, moving a plurality of timber members to desired positions between the platens for joining, rotating the platens to a position where the connector plates are located to span the required joint between the timber members either before or after moving said timber members, pressing said platens towards each other so that the spikes of said connector plates are embedded in opposite faces of said timber members to join together, and retracting said platens leaving said connector plates embedded in said timber members.

2. Apparatus for use in joining timber members using spiked timber connector plates, said apparatus comprising a frame, a pair of spaced, substantially parallel platens in said frame adapted to be moved towards each other with appropriate force, connector plate supply means adapted to supply at least one connector plate onto an appropriate surface of each platen, and moving and positioning means adapted to move and position said connector plates in a position where said connector plates span the joint between the timber members to be connected, the construction and arrangement being such that in use one plate delivered to each of said platens is moved and positioned so that the connector plate spans the joint to be made and the platens are then moved to press the spike of each connector plate into the timber so as to make a joint between the timber members appropriately positioned in the apparatus, said moving means comprising rotation means adapted to rotate at least one said platen, the axis of rotation of said one platen being substantially perpendicular to said appropriate surface, said positioning means including stop means adapted to restrain said one platen from rotating when said connector plate is in a desired position, so as to span the joint between the timber members to be connected.

3. Apparatus as claimed in claim 2 wherein each connector plate is held on said appropriate surface of at least one platen by magnetic means, said connector plate supply means comprising cassettes adapted to contain a supply of connector plates, said cassettes being counterbalanced so that in use an outer connector plate in each cassette is maintained in substantially the same position regardless of the quantity of connector plates remaining in the cassette, connector plate release means being provided so that in use said connector plate release means may be operated by movement of said platen to release a single connector plate at a time from a supply thereof, said connector plate release means comprising a body pivotally attached to said cassette said body including a tongue arranged so that said body may pivot to project said tongue into the mouth of said cassette, spring means to hold said tongue normally projecting into the mouth of said cassette and a projecting actuation member adapted to pivot said body in order to withdraw said tongue from the mouth of said cassette when said actuation member is contacted and moved by the approach of said platen to the mouth of said cassette so that a connector plate may be released from the mouth of said cassette into the surface of said platen.

4. Apparatus for use in joining timber members using spiked timber connector plates, said apparatus comprising a frame, a pair of platens in said frame adapted to be moved towards each other with appropriate force, connector plate supply means adapted to supply at least one connector plate onto an appropriate surface of each platen, and moving and positioning means adapted to move and position said connector plates in a position where said connector plates span the joint between the timber members to be connected, the construction and arrangement being such that in use the connector plates delivered to each of said platens are moved and positioned so that the connector plates span the joint to be made and the platens are then moved to press the spike of each connector plate into the timber so as to make a joint between at least two timber members appropriately positioned in the apparatus, said moving means comprising rotation means adapted to rotate one said platen, the axis of rotation of said one platen being substantially perpendicular to said appropriate surface, said positioning means including stop means adapted to restrain said one platen from rotating when said connector plate is in a desired position, so as to span the joint between the timber members to be connected, said rotation means comprising a motor pivotally mounted to said frame and adapted to drive said one platen by way of a friction drive wheel bearing a surface of said one platen, said motor being actuated by a switch in conjunction with said pivotal mounting so that as said one platen moves away from said drive wheel said mounting will pivot to actuate said motor by way of said switch whereupon said one platen returning to its original position will be contracted by the now rotating friction drive wheel to rotate said platen until a projection on said platen actuates a further stationary position.

5. Apparatus for use in joining timber members using spiked timber connector plates, said apparatus comprising a frame, a pair of platens in said frame adapted to be moved towards each other with appropriate force, connector plate supply means adapted to supply at least one connector plate onto an appropriate surface of each platen, and moving and positioning means adapted to move and position said connector plates in a position where said connector plates span the joint between the timber members to be connected, the construction and arrangement being such that the connector plates delivered to said platens are moved and positioned so that the connector plates span the joint to be made and the platens are then moved to press a spike of each connector plate into the timber so as to make a joint between at least two timber members appropriately positioned in the apparatus, said frame including locating means to locate a first timber member in a desired position, first timber fixing means to hold said first timber member in said desired position and second timber fixing means to hold at least a second timber member in position to abut said first timber member so that the joint between at least two adjacent timber members will in use be spanned by said connector plates when in position, said locating means comprising a spring loaded detent adapted to be depressed by a timber member passing through said frame in one direction in order to allow the passage of said timber member in that direction and also adapted to resist depression by a timber member passing through said frame in the opposite direction so that in use a timber member may be longitudinally passed through said frame until the trailing end of the timber member has cleared said detent whereupon the movement of said timber member may be reversed until said end abuts said detent so locating said end of said timber member relative to said frame, said first timber fixing means comprising a support member arranged longitudinally with reference to said first timber member in use and a holding member actuable to wedge said first timber member between said support member and said holding member, said second timber fixing means comprising a support member arranged longitudinally with reference to said second timber member in use and a securing member actuable to wedge said second timber member between said support members and said securing member including at least one eccentric knob pivoted to said securing member by a pivot in such a manner that in use when said securing member is actuated to wedge said second timber member between said support member and said securing members said eccentric knob engages with said second timber member at a point offset from said pivot so tending to rotate said eccentric knob about said pivot providing a longitudinal force on said second timber member to ensure that said second timber member is abutted against said first timber member.

* * * * *